United States Patent [19]

Österle et al.

[11] Patent Number: 4,628,967

[45] Date of Patent: Dec. 16, 1986

[54] CLOTH DRAW-OFF APPARATUS FOR A WEAVING MACHINE

[75] Inventors: Gerhard Österle, Koblach, Austria; Wilhelm Hutter, Roggwil, Switzerland

[73] Assignee: Aktiengesellschaft Adolph Saurer, Arbon, Switzerland

[21] Appl. No.: 764,927

[22] Filed: Aug. 12, 1985

[30] Foreign Application Priority Data

Aug. 24, 1984 [CH] Switzerland ..... 4045/84

[51] Int. Cl.[4] ..... D03D 49/20

[52] U.S. Cl. ..... 139/1 R; 139/304; 364/470

[58] Field of Search ..... 139/304, 307–311, 139/1 R, 99; 364/470

[56] References Cited

U.S. PATENT DOCUMENTS 3,878,872 4/1975 Hintsch ..... 139/311 X
4,241,764 12/1980 Foltyn et al. ..... 139/1 R
4,582,095 4/1986 Kronholm ..... 139/1 R

FOREIGN PATENT DOCUMENTS 3341238 5/1984 Fed. Rep. of Germany .
59-53746 3/1984 Japan ..... 139/304
1277087 6/1972 United Kingdom ..... 139/309

*Primary Examiner*—James Kee Chi
*Attorney, Agent, or Firm*—Werner W. Kleeman

[57] ABSTRACT

A cloth draw-off roll is operatively connected via a regulation circuit with a main shaft of the weaving machine. The regulation circuit contains a controllable motor which is drivingly connected with the cloth draw-off roll. A regulation circuit arrangement connected forwardly of the controllable motor controls the weft thread density in the drawn-off cloth as a function of at least the rotational angular position of the main shaft of the weaving machine and contains a modulator operatively connected with the controllable motor. The modulator transforms control commands of a programming stage pre-programmable via an input device, into control signals for the controllable motor. A pulse transmitter at the main shaft transmits pulses indicative of the rotational angular position of the main shaft to the programming stage. A control circuit arrangement of the weaving machine transmits information signals or data indicative of the momentary functional state of the weaving machine to the programming stage.

5 Claims, 4 Drawing Figures

CLOTH DRAW-OFF APPARATUS FOR A WEAVING MACHINE

BACKGROUND OF THE INVENTION

The present invention relates to a new and improved construction of a cloth draw-off apparatus for drawing-off cloth woven from warp threads and weft threads in a weaving machine containing a rotatable main shaft.

In its more particular aspects, the present invention specifically relates to a cloth draw-off apparatus for drawing-off cloth or fabric woven with a cloth or fabric fell from warp threads and weft threads in a weaving machine containing a rotatable main shaft and a cloth draw-off roll which is operatively connected via a regulation circuit or regulation means with the main shaft of the weaving machine. The regulating circuit or means comprises a controllable motor which is drivingly connected with the cloth draw-off roll. A regulation circuit arrangement is connected forwardly of the controllable motor in order to control the weft thread set density in the drawn-off cloth as a function of at least the rotational angular position of the main shaft of the weaving machine.

Hitherto known cloth draw-off apparatuses in weaving machines are drivingly connected via transmission means with the main shaft of the weaving machine in order to draw-off the woven cloth in front of the reed of the weaving machine at a predetermined ratio relative to the rotational speed of the weaving machine. Thus the weft thread set per unit length i.e. the weft thread density of the cloth is determined by means of the draw-off rate. Generally, the gear ratio of the known transmission means can be adjusted continuously or in relatively small steps. Apparatus of this type, then, permits the operation at a pre-adjusted gear ratio at all rotational speeds of the weaving machine and thus there should theoretically result the same weft thread set or weft thread density at all rotational speeds.

In practice, however, particularly during a weaving operation using warp and weft material which renders well recognizable a change in the weft thread set or density in the finished cloth, it is noted that, for reasons determined by the technical properties of the weaving machine and by the textile properties of the warp and weft material, significant problems relating to variations in the weft thread density appear due to the use of pre-adjusted transmission means during shut-down and start-up of the weaving machine.

Such variations in the weft thread density may occur for different reasons, for example, due to an elongation or stretching of the warp threads, particularly warp threads made of an elastic material, during shut-down of the weaving machine. In such case the cloth fell of the cloth including the last beat-up weft thread, is moved away from the reed under the tension exerted by the warp threads during shut-down or standstill of the weaving machine. Consequently, at least the first weft thread after restarting the weaving machine is beaten-up against the cloth or fabric fell at a greater distance than the distance which is pre-adjusted by means of the gear ratio of the transmission means between the main shaft of the weaving machine and the cloth draw-off roll. As a result, so-called expanded regions are formed.

The different dynamic behavior of the weaving machine, for example, during start-up, further results in variations of the weft thread density, for example, due to changes in the distance of the reed from the cloth or fabric fell which leads to so-called start-up streaks.

Very frequently, both of the aforementioned defects appear conjointly.

In order to counteract such defects, various measures have been taken at the known cloth draw-off apparatus.

For example, during the first weft insertion after starting up the weaving machine, the cloth draw-off operation is decoupled from the operation of the weaving machine and the weft thread is not inserted. In this manner it is achieved that the weaving machine runs at full rotational speed during the second weft insertion and thus the dynamic behavior of the weaving machine corresponds to the behavior at full rotational speed. In order to also compensate for the formation of the expanded regions, the transmission means then, during the second weft insertion, must be engaged with a delay of an amount corresponding to the extent of the elongation or stretching of the warp threads.

In another known method the cloth draw-off transmission or the cloth or fabric fell is reset prior to the start of the weaving machine by an amount required in order to compensate for the aforementioned elongation or stretching of the warp threads as well as the variant dynamic behavior of the weaving machine during the first weft insertion. In the case that this reset is intended to be automatically effected, the cloth draw-off transmission must be decoupled prior to the start-up of the weaving machine and re-engaged using controlled drive means. When this function is intended to be manually performed, high reliability of the operating personnel is required.

Transmission means of the aforementioned type additionally also permit, to a certain extent, variations in the weft thread density, particularly when such transmission means comprise worm-gear arrangements driven by means of a ratchet wheel which contains a ratchet capable of performing oscillating movements and which ratchet can be lifted-off from the ratchet wheel for the special case of an increased weft thread density.

It is readily seen that these previously described means for affecting the weft thread density at the drawn-off cloth for compensating or preventing the formation of expanded regions and start-up streaks as well as for intentionally varying the weft thread density, are very expensive and still do not satisfy present requirements.

SUMMARY OF THE INVENTION

Therefore, with the foregoing in mind it is a primary object of the present invention to provide a new and improved construction of a cloth draw-off apparatus for drawing-off cloth woven from warp threads and weft threads in a weaving machine containing a rotatable main shaft and which apparatus is not afflicted with the aforementioned drawbacks and limitations of the prior art constructions.

It is a more specific object of the present invention to provide a new and improved construction of a cloth draw-off apparatus for drawing-off cloth woven from warp threads and weft threads in a weaving machine containing a rotatable shaft and in which cloth draw-off apparatus the draw-off rate and thus the weft thread density in the cloth can be adjusted continuously or in small steps and without the exchange or readjustment of mechanical elements.

Another significant object of the present invention is directed to a new and improved construction of a cloth draw-off apparatus for drawing-off cloth woven from warp threads and weft threads in a weaving machine containing a rotatable main shaft and by means of which cloth draw-off apparatus variations in the weft thread density due to start-up operations at the weaving machine and/or elongation or stretching of the warp thread material and the like, as compared to a pre-adjusted weft thread density during normal operation of the weaving machine, can be programmed and automatically compensated for.

It is a further important object of the present invention to provide a new and improved construction of a cloth draw-off apparatus for drawing-off cloth woven from warp threads and weft threads in a weaving machine containing a rotatable main shaft and which cloth draw-off apparatus offers the possibility of introducing programmed variations in the weft thread density during the operation of the weaving machine.

Now in order to implement these and still further objects of the invention, which will become more readily apparent as the description proceeds, the cloth draw-off apparatus of the present development is manifested by the features that, the regulation circuit arrangement comprises a modulator which is operatively connected with the controllable motor. The modulator transforms control commands received from a programming stage which is pre-programmable via an input device, into control signals for controlling the controllable motor. The programming stage is connected to at least one pulse transmitter which is arranged at least at the main shaft and which generates signals indicative of the rotational angular position of the main shaft and received by the programming stage. The programming stage is also connected with a control circuit arrangement which generates information signals or data indicative of the momentary functional state of the weaving machine and received by the programming stage.

In an advantageous construction of the inventive cloth draw-off apparatus, the programming stage is connected with a further pulse transmitter which is operatively connected with the cloth draw-off roll and transmits pulses which are indicative of the rotational angular position of the cloth draw-off roll. As a result, the reference value and the actual value of the relative rotational angular positions of the main shaft and of the cloth draw-off roll of the weaving machine can be directly evaluated.

It has further proven advantageous to precisely determine the position of the cloth or fabric fell after a shut-down of the weaving machine and prior to a restart of the weaving machine in order to obtain an optimum reset of the cloth or fabric fell. In an advantageous embodiment of the inventive cloth draw-off apparatus such optimum reset of the cloth or fabric fell can be accomplished by connecting the programming stage with measuring means for detecting the position of the cloth or fabric fell. Opto-electronic or electromechanical types of measuring means can be used for this purpose.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
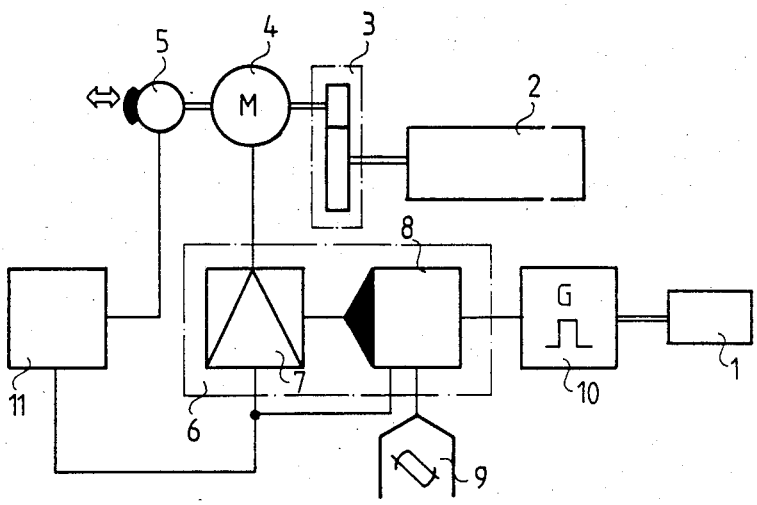
FIG. 1 is a schematic block circuit diagram of a first exemplary embodiment of the inventive cloth draw-off apparatus.

Describing now the drawings, it is to be understood that only enough of the construction of the cloth draw-off apparatus has been shown as needed for those skilled in the art to readily understand the underlying principles and showing of the drawings. Turning attention now specifically concepts of the present development, while simplifying the to FIG. 1 of the drawings, there has been shown in a schematic block circuit diagram a first exemplary embodiment of the inventive cloth draw-off apparatus. The weaving machine essentially is only schematically indicated by its main shaft 1. A so-called cloth draw-off roll 2 serves the purpose of drawing off the cloth at all operational states of the weaving machine in such a manner that the distance between the reed 13, see FIG. 3, and the cloth or fabric fell 14 also shown in FIG. 3, or the distance between two weft threads which are beaten up at the cloth or fabric fell, remains constant in accordance with a pre-adjusted value.

A regulating circuit or means is provided in order to realize such constant distance. The regulating circuit or means encompasses a controllable motor 4 which is drivingly connected with the cloth draw-off roll 2. A regulation circuit arrangement 6 is connected forwardly of the controllable motor 4 and contains a modulator 7 which is operatively connected with the controllable motor 4. The modulator 7 transforms control commands received from a programming stage 8 which is pre-programmable by means of an input device 9, into control signals for the controllable motor 4. The programming stage 8 is connected to a pulse transmitter 10 arranged at the main shaft 1 and transmitting pulses which are indicative of the rotational angular position of the main shaft 1 and which are received by the programming stage 8. The programming stage 8 is also connected with a control circuit arrangement 11 and receives therefrom information signals or data about the momentary functional state of the weaving machine. The modulator 7 is also connected to the control circuit arrangement 11. Due to the afore-described circuit connections the modulator 7 and the programming stage 8 obtain or receive data constituting actual function signals, for example, for initiating the start, the slow run, the shut-down or stop and so forth of the weaving machine and for initiating the program runs of the programming stage 8 which are described in more detail hereinbelow.

The controllable motor 4, for example, constitutes a servo motor which is controllable with respect to its rotational angular movement, or a stepping motor which runs in small steps. Furthermore, the cloth draw-off roll 2 may be directly driven by the controllable motor 4 or may be driven via transmission means 3 as in the illustrated embodiment.

The shaft of the controllable motor 4 or any other suitable element of the cloth draw-off apparatus can be provided with, for example, an arresting or stopping brake 5 or any other suitable means like, for example, a ratchet wheel for preventing a reverse run of the controllable motor 4. In this a manner the entire apparatus maintains its position also in the currentless state of the controllable motor 4.

The aforementioned programming stage 8 is enabled to produce pulse sequences at the modulator 7 from the sequences of pulses which are indicative of the main shaft rotational angular position and which are generated by the pulse transmitter 10, in correspondence to the program commands delivered by means of the input device 9 and the function-related commands originating from the control circuit arrangement 11 of the weaving machine. Such pulse sequences produced by the programming stage 8 cause the controllable motor 4 to execute a rotational angular motion corresponding to the momentary situation or condition.

For the following consideration it is assumed that the controllable motor 4 constitutes a stepping motor and that such stepping motor, due to a programmed command which is input by means of the input device 9 into the programming stage 8 during normal operation of the weaving machine, must execute one step per each one-hundred pulses generated by the pulse transmitter 10 and indicative of the rotational angular position, in order to obtain a predetermined weft thread density of the cloth. The programming stage 8 then performs a pulse reduction in the ratio of 100 to 1. This programming stage 8 thus transmits, per 100 input pulses, one control pulse to the modulator 7 which, in turn, inputs a motor stepping pulse into the controllable motor 4.

For the "machine stop" function, the programming stage 8, for example, is programmed by means of the input device 9 in such a manner that the controllable motor 4 still performs the number of steps required for the pre-adjusted weft thread density during the run of the weaving machine, within the final revolution or rotation of the weaving machine main shaft during which the machine stop occurs.

During the start-up of the weaving machine there must be taken account of the fact that the warp threads have been elongated or stretched during the shut-down or standstill or that the cloth or fabric fell 14 has been displaced from the reed 13 as well as that the weaving machine does not reach its full rotational speed during the first reed beat-up. A variation in the weft thread density results from these two deviations from the normal state, namely, due to an increase in the distance between two weft threads which results in a "thin spot". Furthermore, the elongation or stretching is dependent upon the type of weft thread material and increases with increasing shut-down or standstill periods of the weaving machine.

In order to compensate for the two deviations or factors which may result in the aforementioned thin spot formation, a corrective factor for the first weft insertion cycles after the start of the weaving machine is input into the programming stage 8 by means of the input device 9. This corrective factor is based on the following components: elongating or stretching behavior of the warp material, duration of the shut-down or standstill period of the weaving machine, and deviation of the dynamic behavior of the weaving machine due to the lower rotational speed during the first weft insertion. For example, there can be delivered or input into the programming stage 8 by means of the input device 9 that the reduction ratio between the number of pulses which are indicative of the main shaft rotational angle and which are generated by the pulse transmitter 10, and the number of steps to be executed by the stepping motor 4 must amount to 108:1 during the first step, 103:1 during the second step, 101:1 during the third step, and 100:1 following the fourth step after the start of the weaving machine.

However, it is also possible that the cloth or fabric fell 14 prior to starting the weaving machine is reset at least by the amount of the elongation or stretching or additionally thereto also by an amount which compensates for the aforementioned thin spot which is formed due to the different dynamic behavior of the weaving machine at the low rotational speed during the first reed beat-up. During this operation the controllable motor 4 performs a number of reverse steps which have been input by the input device 9 into the programming stage 8 with respect to the function "machine start". The signal related to the function "start" is delivered by the control circuit arrangement 11 of the weaving machine, for example, to the modulator 7 and to the programming stage 8.

Figure 3:
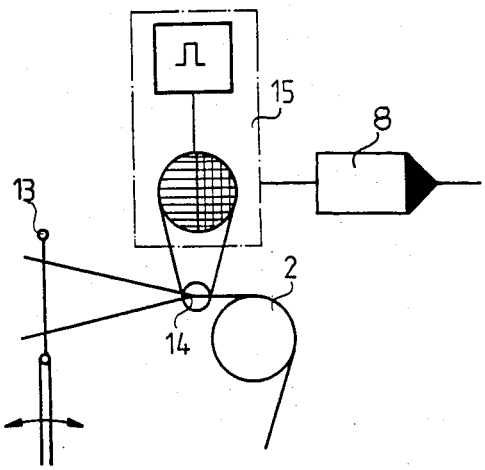
FIG. 3 is a schematic block circuit diagram illustrating a detail of a third embodiment of the inventive cloth draw-off apparatus which contains the cloth draw-off apparatus shown in FIG. 1 or FIG. 2 and measuring means for determining the position of the cloth or fabric fell after a shut-down of the weaving machine.
Figure 4:
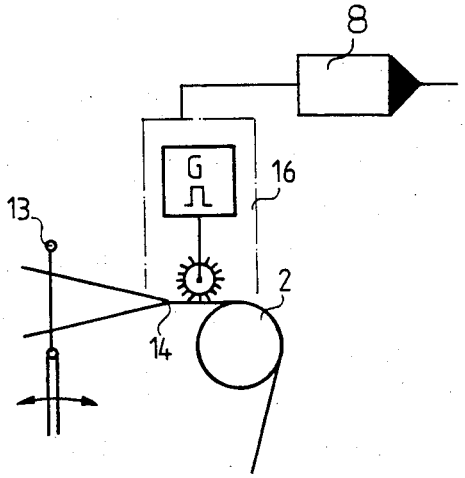
FIG. 4 is a schematic block circuit diagram illustrating a detail of a fourth embodiment of the inventive cloth draw-off apparatus which contains the cloth draw-off apparatus shown in FIG. 1 or FIG. 2 and an alternative measuring means for determining the cloth or fabric fell position after a shut-down of the weaving machine.

Another possibility of resetting the cloth or fabric fell 14 prior to the start exists in determining the position of the cloth or fabric fell 14 after a machine stop by using position measuring means 15 or 16, see FIGS. 3 and 4, respectively, and then resetting the cloth or fabric fell 14 prior to the start into or beyond the previous position by taking account of the position signals generated by the position measuring means 15 or 16. During this operation the controllable motor 4 performs backward or reverse steps due to the function signal "start" generated by the control circuit arrangement 11 of the weaving machine until the position measuring means 15 or 16 signal that the starting position of the cloth or fabric fell 14 is reached.

The measuring means for determining the position of the cloth or fabric fell 14, particularly after a shut-down or standstill of the weaving machine, may constitute opto-electronic measuring means 15 of a third exemplary embodiment of the inventive cloth draw-off apparatus illustrated in FIG. 3 or electromechanical measuring means 16 of a fourth exemplary embodiment of the inventive cloth draw-off apparatus illustrated in FIG. 4.

Figure 2:
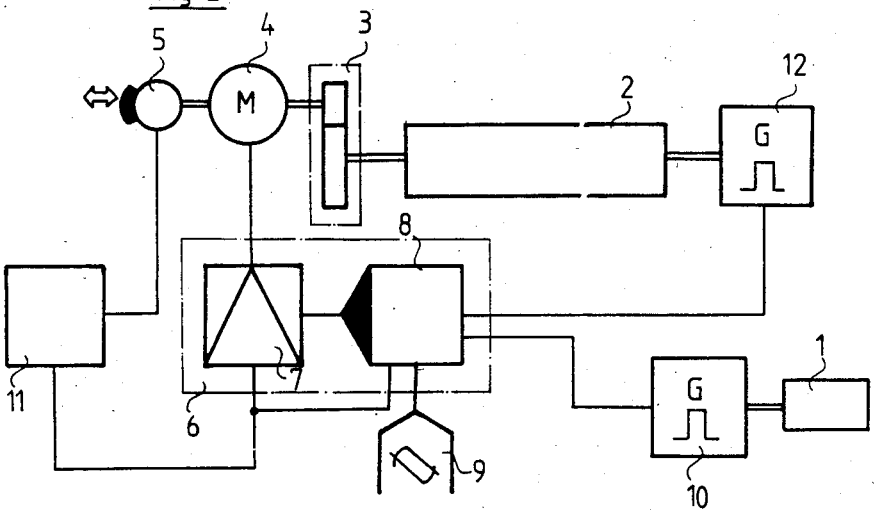
FIG. 2 is a schematic block circuit diagram illustrating a second exemplary embodiment of the inventive cloth draw-off apparatus.

In the second exemplary embodiment of the inventive cloth draw-off apparatus illustrated in FIG. 2, the programming stage 8 additionally is connected to a further pulse transmitter 12 which is operatively associated with the rotation of the cloth draw-off roll 2.

This arrangement is particularly suitable for the case that the controllable motor 4 constitutes a servo motor. The further pulse transmitter 12 determines the rotational angle for each weft insertion cycle.

The pulse transmitter 10 which is driven by means of the main shaft 1 and transmits pulses indicative of the rotational angle of the main shaft 1, merely causes maintenance of a minimum synchronization between the rotational speed of the main shaft 1 and the controllable motor 4 during a change in the rotational speed of the main shaft 1, for example, during the start or stop of the weaving machine.

The programming stage 8 produces a command signal for the modulator 7 by means of which there is generated a motor current which constantly causes the motor rotational speed to have a small or minimum deviation from a predetermined reference speed. This is due to the fact that the ratio of the pulse numbers generated by the pulse transmitter 10 and the further pulse transmitter 12, which ratio is input into the programming stage 8 by means of the input device 9, is intended to remain the same at all rotational speeds of the main shaft 1.

In order to prevent standstill and start-up streaks and for compensating deviations during the start of the weaving machine, pulse ratios which deviate from the normal pulse ratio, are programmed into the programming stage 8 by means of the input device 9 for the first weft insertion cycles after the start of the weaving machine. These deviating pulse ratios are led back in steps to the normal value of such pulse ratio.

In case that the compensation prior to the start of the weaving machine is intended to be performed by resetting the cloth or fabric fell 14, the controllable motor 4 receives a reverse run command via the modulator 7 and due to the starting signal generated by the control circuit arrangement 11 of the weaving machine. The reverse run command is in accordance with the number of pulses generated by the further pulse transmitter 12 and which number is input into the programming stage 8 by means of the input device 9.

In case that the reset of the cloth or fabric fell 14 prior to the start of the weaving machine is performed by using the position measuring means 15 or 16, the controllable motor 4 runs backwards upon the appearance of the start signal generated by the control circuit arrangement 11 of the weaving machine and until a stop command is issued by the position measuring means 15 or 16.

Using both the aforementioned methods, continuously increasing and decreasing or undulating or stepped variations in the weft thread density can be achieved by correspondingly varying the pulse ratio in the programming stage 8. This pulse ratio is the ratio between input and output pulses of the programming stage 8, when a stepping motor is employed. This pulse ratio is the ratio of the pulses transmitted by the pulse transmitter 10 and the further transmitter 12 and indicative of the related rotational angles when the controllable motor 4 constitutes a servo motor.

Corresponding program changes in the programming stage 8 are performed using the input device 9.

The foregoing description shows that the inventive cloth draw-off apparatus satisfies all requirements in a relatively simple and functionally reliable manner. Particularly, the inventive cloth draw-off apparatus enables the adjustment of the cloth draw-off rate and thus of the weft thread density in the cloth in small steps and without an exchange or readjustment of mechanical elements. Furthermore, the inventive cloth draw-off apparatus enables the compensation of variations in the weft thread density due to start-up operations of the weaving machine and/or due to elongation or stretching of the warp thread material and so forth in comparison to a pre-adjusted weft thread density during the normal run of the weaving machine. The inventive cloth draw-off apparatus further permits performing programmed variations in the weft thread density during the run of the weaving machine.

While there are shown and described present preferred embodiments of the invention, it is to be distinctly understood that the invention is not limited thereto, but may be otherwise variously embodied and practiced within the scope of the following claims.

Accordingly, what we claim is:

1. A cloth draw-off apparatus for drawing-off cloth woven from warp threads and weft threads in a weaving machine containing a rotatable main shaft, said cloth draw-off apparatus comprising:

a cloth draw-off roll operatively connected with said main shaft of the weaving machine;

regulating means operatively connecting said cloth draw-off roll and said main shaft of said weaving machine;

said regulating means containing a controllable motor drivingly connected with said cloth draw-off roll;

said regulating means further containing a regulating circuit arrangement connected forwardly of said controllable motor in order to control weft thread density as a function of at least the rotational angular position of the weaving machine main shaft;

said regulating means containing a modulator;

said modulator being operatively connected with said controllable motor;

a pre-programmable programming stage operatively connected with said modulator and generating control commands;

an input device for pre-programming said programming stage;

said modulator receiving said control commands and transforming the control commands into control signals for controlling said controllable motor;

a pulse transmitter arranged at least at said main shaft of the weaving machine and generating pulses indicative of the rotational angular position of said main shaft of said weaving machine;

said pre-programmable programming stage being connected with said pulse transmitter and receiving therefrom said pulses indicative of said rotational angular position of said main shaft of the weaving machine;

a control circuit arrangement generating information signals indicative of the momentary functional state of the weaving machine; and said pre-programmable programming stage being connected with said control circuit arrangement and receiving therefrom said information signals indicative of said momentary functional state of said weaving machine.

2. The cloth draw-off apparatus as defined in claim 1, further including:

a further pulse transmitter operatively associated with said cloth draw-off roll; and said further pulse transmitter being operatively connected with said pre-programmable programming stage.

3. The cloth draw-off apparatus as defined in claim 1, further including:

positioning measuring means connected with said programming stage;

said cloth woven in the weaving machine defining a cloth fell; and said position measuring means determining the position of said cloth fell.

4. The cloth draw-off apparatus as defined in claim 3, wherein:

said position measuring means constitute opto-electronic measuring means.

5. The cloth draw-off apparatus as defined in claim 3, wherein:

said position measuring means constitute electromechanical measuring means.

* * * * *

UNITED STATES PATENT AND TRADEMARK OFFICE

CERTIFICATE OF CORRECTION

PATENT NO. : 4,628,967

DATED : December 16, 1986

INVENTOR(S) : GERHARD OESTERLE and al

It is certified that error appears in the above—identified patent and that said Letters Patent is hereby corrected as shown below:

Column 4, line 29, after "and" please insert --concepts of the present development, while simplifying the--

Column 4, line 30, after "specifically" please delete "concepts of the present development, while simplifying the"

Signed and Sealed this

Fourteenth Day of April, 1987

*Attest:*

DONALD J. QUIGG

*Attesting Officer*

*Commissioner of Patents and Trademarks*